US010338488B2

(12) United States Patent
Igarashi et al.

(10) Patent No.: US 10,338,488 B2
(45) Date of Patent: Jul. 2, 2019

(54) IMAGE FORMING APPARATUS

(71) Applicant: FUJI XEROX CO., LTD., Tokyo (JP)

(72) Inventors: Tatsuhiro Igarashi, Kanagawa (JP); Manabu Furuki, Kanagawa (JP); Naoki Ota, Kanagawa (JP); Makoto Kamisaki, Kanagawa (JP); Yasuhisa Morooka, Kanagawa (JP); Jun Sekiya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/915,843

(22) Filed: Mar. 8, 2018

(65) Prior Publication Data

US 2019/0094731 A1 Mar. 28, 2019

(30) Foreign Application Priority Data

Sep. 26, 2017 (JP) ..... 2017-185235

(51) Int. Cl.

*G03G 15/20* (2006.01)
*G03G 9/087* (2006.01)
*G03G 15/08* (2006.01)

(52) U.S. Cl.

CPC ..... *G03G 9/08755* (2013.01); *G03G 15/08* (2013.01); *G03G 15/2007* (2013.01); *G03G 15/2017* (2013.01); *G03G 2215/2074* (2013.01)

(58) Field of Classification Search

CPC ..... G03G 15/2007; G03G 15/2021; G03G 9/08755; G03G 15/2017

See application file for complete search history.

(56) References Cited

U.S. PATENT DOCUMENTS

| | | | | |
|---|---|---|---|---|
| 7,773,931 | B2 * | 8/2010 | Jung | G03G 15/2064 399/328 |
| 9,052,621 | B2 | 6/2015 | Kusahara et al. | |
| 2014/0322643 | A1 | 10/2014 | Watanabe et al. | |

FOREIGN PATENT DOCUMENTS

| | | | | |
|---|---|---|---|---|
| JP | 10268558 | A * | 10/1998 | |
| JP | 2005-283927 | A | 10/2005 | |
| JP | 4320234 | B2 | 8/2009 | |
| JP | 2015083668 | A * | 4/2015 | |
| JP | 5900789 | B2 | 4/2016 | |
| WO | WO-2009072823 | A2 * | 6/2009 | G03G 9/0819 |
| WO | WO-2010120060 | A2 * | 10/2010 | G03F 9/0821 |

OTHER PUBLICATIONS

English language machine translation of JP 10-268558 (Oct. 1998).*
Diamond, Arthus S. (editor) Handbook of Imaging Materials. New York Marcel-Dekker, Inc. (2001) pp. 145-164.*

* cited by examiner

*Primary Examiner* — Christopher D Rodee
(74) *Attorney, Agent, or Firm* — Oliff PLC

(57) ABSTRACT

An image forming apparatus includes an image holding member, a charging device, an electrostatic charge image forming device, a developing device having a toner, a transfer device, and a fixing device, wherein the fixing device includes a fixing belt, a rotational member, and a heater; the toner contains an amorphous polyester resin as a binder resin; and the toner has a weight average molecular weight Mw and a number average molecular weight Mn, Mw is from 25000 to 60000, and Mw/Mn is from 5 to 10, and has an infrared absorption spectrometry, the ratio of absorbance for a wavelength of 1500 $cm^{-1}$ to absorbance for a wavelength of 720 $cm^{-1}$ is 0.6 or less, and the ratio of absorbance for a wavelength of 820 $cm^{-1}$ to absorbance for a wavelength of 720 $cm^{-1}$ is 0.4 or less.

19 Claims, 4 Drawing Sheets

IMAGE FORMING APPARATUS

CROSS-REFERENCE TO RELATED APPLICATIONS

This application is based on and claims priority under 35 USC 119 from Japanese Patent Application No. 2017-185235 filed Sep. 26, 2017.

BACKGROUND

(i) Technical Field

The present invention relates to an image forming apparatus.

(ii) Related Art

An electrophotographic process for forming an image, for example, includes charging the surface of an image holding member, forming an electrostatic charge image on this surface of the image holding member on the basis of image information, developing the electrostatic charge image with a developer containing toner to form a toner image, and transferring and fixing the toner image to the surface of a recording medium.

SUMMARY

According to an aspect of the invention, there is provided an image forming apparatus including an image holding member, a charging device that charges a surface of the image holding member, an electrostatic charge image forming device that forms an electrostatic charge image on the charged surface of the image holding member, a developing device that includes an electrostatic charge image developer containing an electrostatic charge image developing toner and develops the electrostatic charge image to form a toner image on the surface of the image holding member, a transfer device that transfers the toner image onto a recording medium, and a fixing device that fixes the toner image on the recording medium, wherein the fixing device includes a fixing belt that comes into contact with the toner image transferred to the surface of the recording medium, a rotational member that contacts with the outer surface of the fixing belt such that a contact area is formed between the rotational member and the fixing belt and that rotates together with the fixing belt to transport the recording medium, and a heater that is disposed so as to face the inner surface of the fixing belt to heat the contact area formed between the rotational member and the fixing belt; the toner contains a binder resin that is an amorphous polyester resin; the toner has a weight average molecular weight Mw and a number average molecular weight Mn, the weight average molecular weight Mw is in the range of 25000 to 60000, and Mw/Mn is in the range of 5 to 10; and the toner has an infrared absorption spectrometry, the ratio of absorbance for a wavelength of 1500 $cm^{-1}$ to absorbance for a wavelength of 720 $cm^{-1}$ is 0.6 or less, and the ratio of absorbance for a wavelength of 820 $cm^{-1}$ to absorbance for a wavelength of 720 $cm^{-1}$ is 0.4 or less.

BRIEF DESCRIPTION OF THE DRAWINGS

Exemplary embodiment of the present invention will be described in detail based on the following figures, wherein.

DETAILED DESCRIPTION

Figure 1:
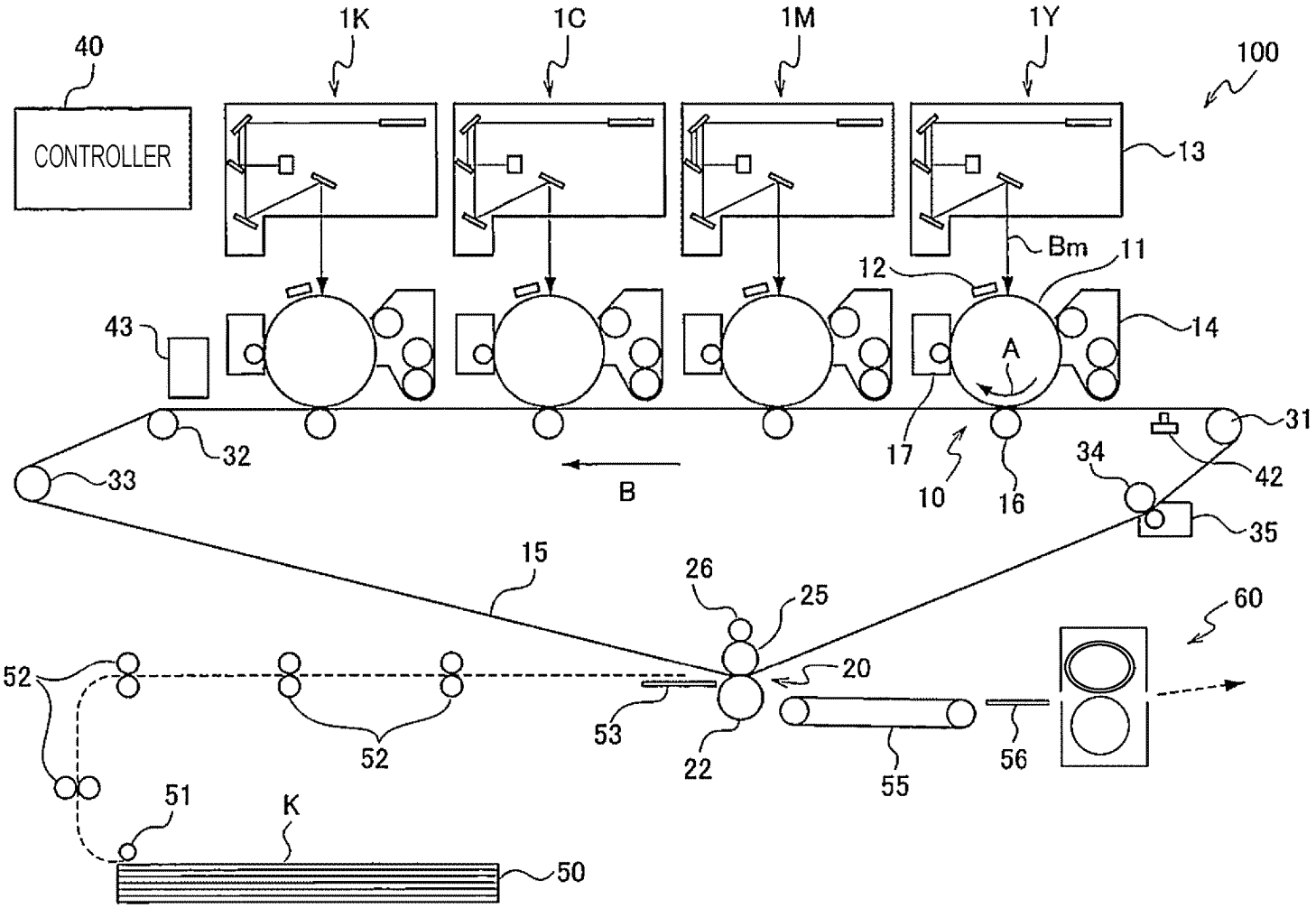
FIG. 1 schematically illustrates an example of the structure of an image forming apparatus according to an exemplary embodiment.

An exemplary embodiment that is an example of the invention will now be described in detail.

Image Forming Apparatus

An image forming apparatus according to an exemplary embodiment includes an image holding member, a charging unit that charges the surface of the image holding member, an electrostatic charge image forming unit that forms an electrostatic charge image on the charged surface of the image holding member, a developing unit that includes an electrostatic charge image developer containing toner and that develops the electrostatic charge image on the surface of the image holding member with the electrostatic-charge-image developer to form a toner image, a transfer unit that transfers the toner image formed on the surface of the image holding member to the surface of a recording medium, and a fixing unit that fixes the toner image transferred to the surface of the recording medium.

The fixing unit includes a fixing belt that comes into contact with the toner image transferred to the surface of the recording medium, a rotational member that contacts with the outer surface of the fixing belt such that a contact area is formed between the rotational member and the fixing belt and that rotates together with the fixing belt to transport the recording medium in the contact area, and a heater that is disposed so as to face the inner surface of the fixing belt to heat the contact area formed between the rotational member and the fixing belt.

The toner (specific toner) contains an amorphous polyester resin as a binder resin and toner particles. When the tetrahydrofuran-soluble component of the toner particles is subjected to an analysis by gel permeation chromatography to determine a weight average molecular weight Mw and a number average molecular weight Mn, Mw is in the range of 25000 to 60000, and Mw/Mn is in the range of 5 to 10. In addition, when the toner particles are analyzed by infrared absorption spectrometry, the ratio of absorbance for a wavelength of 1500 $cm^{-1}$ to absorbance for a wavelength of 720 $cm^{-1}$ is 0.6 or less, and the ratio of absorbance for a wavelength of 820 $cm^{-1}$ to absorbance for a wavelength of 720 $cm^{-1}$ is 0.4 or less.

The term "specific toner" refers to toner containing toner particles of which analysis by infrared absorption spectrometry shows that the ratio of absorbance for a wavelength of 1500 $cm^{-1}$ to absorbance for a wavelength of 720 $cm^{-1}$ is 0.6 or less and that the ratio of absorbance for a wavelength of 820 $cm^{-1}$ to absorbance for a wavelength of 720 $cm^{-1}$ is 0.4 or less. Such infrared absorption spectrum characteristics of the toner mean that the amorphous polyester resin used as a binder resin does not contain an alkylene oxide adduct of bisphenol A (such as ethylene oxide adduct of bisphenol A, propylene oxide adduct of bisphenol A, or ethylene oxide-propylene oxide adduct of bisphenol A) as a polyhydric alcohol or contain it in a slight amount if any.

In order to enhance the fixing properties of a fixed image in which the specific toner is used, the weight average molecular weight Mw and number average molecular weight Mn of a tetrahydrofuran-soluble component contained in the toner particles, which are determined by gel permeation chromatography, are suitably adjusted to be as follows: Mw is from 25000 to 60000, and Mw/Mn is from 5 to 10. In particular, it is suitable that a non-cross-linked binder resin component principally have such molecular weight characteristics.

Specifically, in the case where Mw is less than 25000, hot offset (phenomenon in which toner unnecessarily melts and adheres to fixing members) is likely to occur in a fixing process; in the case where Mw is greater than 60000, the lower limit of the fixing temperature is likely to be enhanced. In the case where Mw/Mn is greater than 10, the resins have a difference in meltability, which results in that a fixed image is likely to have unevenness. Adjusting Mw/Mn to be less than 5 is difficult for the convenience of a production process.

The specific toner (toner particles thereof) having the above-mentioned molecular weight characteristics enables an enhancement in the fixing properties of an image.

Use of the specific toner, however, may result in the occurrence of hot offset (phenomenon in which toner unnecessarily melts and adheres to fixing members in fixing of toner image) in a high temperature and high humidity environment (for example, temperature of 35° C. and humidity of 85%). The cause thereof is speculated as follows.

The specific toner has a high moisture absorbing property attributed to the amorphous polyester resin. The specific toner (toner particles) therefore becomes plasticized in a high temperature and high humidity environment because of absorption of moisture.

In the fixing unit, a phenomenon in which a fixing temperature exceeds a predetermined temperature (also referred to as overshoot) is caused in some cases. The overshoot is likely to be caused in a two roller fixing unit of which the heat capacity is high.

Hence, in the case where a toner image is fixed with such a plasticized specific toner in a high temperature and high humidity environment, the occurrence of overshoot in the fixing unit leads to easy generation of hot offset.

In view of such a circumstance, the image forming apparatus of the exemplary embodiment has the fixing unit including the fixing belt that comes into contact with a toner image transferred to the surface of a recording medium, the rotational member that contacts with the outer surface of the fixing belt such that a contact area is formed between the rotational member and the fixing belt and that rotates together with the fixing belt to transport the recording medium in the contact area, and the heater that is disposed so as to face the inner surface of the fixing belt to heat the contact area formed between the rotational member and the fixing belt.

In particular, the fixing belt having a lower heat capacity than a fixing roller is used as a fixing member, and the heater that directly heats the contact area lying between the fixing belt and the rotational member from the inside of the fixing belt is used.

This structure enables the temperature of the fixing belt to reach the intended fixing temperature in the contact area owing to the heater and causes the temperature to be easily decreased at part of the fixing belt other than the contact area, so that the occurrence of overshoot can be reduced.

Hence, even in the case where a toner image is fixed with a plasticized specific toner in a high temperature and high humidity environment, the occurrence of hot offset is reduced.

Accordingly, in the image forming apparatus of the exemplary embodiment, hot offset caused in a high temperature and high humidity environment can be reduced.

The image forming apparatus of the exemplary embodiment may be any of the following known image forming apparatuses: a direct transfer type apparatus in which the toner image formed on the surface of the image holding member is directly transferred to a recording medium, an intermediate transfer type apparatus in which the toner image formed on the surface of the image holding member is transferred to the surface of an intermediate transfer body and in which the toner image transferred to the surface of the intermediate transfer body is then transferred to the surface of a recording medium, and an apparatus which has an erasing unit that radiates light to the surface of the image holding member for removal of charges after the transfer of the toner image and before charging.

In the intermediate transfer type apparatus, the transfer unit, for example, includes an intermediate transfer body of which a toner image is to be transferred to the surface, a first transfer member which transfers the toner image formed on the surface of the image holding member to the surface of the intermediate transfer body, and a second transfer member which transfers the toner image transferred to the surface of the intermediate transfer body to the surface of a recording medium.

In the structure of the image forming apparatus of the exemplary embodiment, for instance, the part that at least includes the image holding member may be in the form of a cartridge that is removably attached to the image forming apparatus (process cartridge).

The image forming apparatus of the exemplary embodiment will now be described with reference to the drawings.

FIG. 1 schematically illustrates an example of the structure of the image forming apparatus of the exemplary embodiment.

As illustrated in FIG. 1, an image forming apparatus 100 of the exemplary embodiment is, for example, an intermediate transfer type image forming apparatus that is a so called tandem type. The image forming apparatus 100 includes image forming units 1Y, 1M, 1C, and 1K that individually form toner images of different color components by an electrophotographic technique; first transfer parts 10 that transfers the toner images of different color components formed by the image forming units 1Y, 1M, 1C, and 1K to an intermediate transfer belt 15 in sequence (first transfer); a second transfer part 20 that collectively transfers the toner images transferred onto the intermediate transfer belt 15 to paper K as a recording medium (second transfer); and a fixing device 60 (example of fixing unit) that fixes the images subjected to the second transfer onto the paper K. The image forming apparatus 100 further includes a controller 40 that gives information to each device (part) or receives information from it to control the operation thereof.

A unit having the intermediate transfer belt 15, the first transfer parts 10, and the second transfer part 20 corresponds to an example of the transfer unit.

Each of the image forming units 1Y, 1M, 1C, and 1K of the image forming apparatus 100 has a photoreceptor 11 as an example of the image holding member that carries a toner image formed on the surface thereof, and the photoreceptor 11 rotates in the direction indicated by the arrow A.

In the vicinity of the photoreceptor 11, a charger 12 that is an example of the charging unit is provided to charge the photoreceptor 11, and a laser exposure unit 13 that is an example of the electrostatic charge image forming unit is provided to write an electrostatic charge image on the photoreceptor 11 (exposure beam is indicated by the sign Bm in the drawing).

Also in the vicinity of the photoreceptor 11, a developing unit 14 that includes toner of a corresponding color component is provided as an example of the developing unit to turn the electrostatic charge image on the photoreceptor 11 into a visible image with toner, and a first transfer roller 16 that transfers the toner image of a corresponding color component on the photoreceptor 11 to the intermediate transfer belt 15 at the first transfer part 10.

The above-mentioned specific toner is used as toner of at least one of the color components. In the exemplary embodiment, it is suitable that the toner of each of the color components be the specific toner.

Furthermore, a photoreceptor cleaner 17 is provided in the vicinity of the photoreceptor 11 to remove residual toner on the photoreceptor 11. The electrophotographic devices of the charger 12, laser exposure unit 13, developing unit 14, first transfer roller 16, and photoreceptor cleaner 17 are provided in sequence in the rotational direction of the photoreceptor 11. The image forming units 1Y, 1M, 1C, and 1K are disposed substantially in line in the order of yellow (Y), magenta (M), cyan (C), and black (K) from the upstream side of the intermediate transfer belt 15.

The intermediate transfer belt 15 is driven and circulates (rotates) by rollers at the intended rate in the direction denoted by the sign B in FIG. 1. Such rollers include a driving roller 31 that is driven by a motor (not illustrated) to rotate the intermediate transfer belt 15, a supporting roller 32 that supports the intermediate transfer belt 15 extending substantially in line along the direction in which the photoreceptors 11 are disposed, a tensile roller 33 that gives the intermediate transfer belt 15 tension and that functions as a correction roller that reduces meandering of the intermediate transfer belt 15, a back roller 25 provided to the second transfer part 20, and a cleaning back roller 34 provided to a cleaning part that scrapes off residual toner on the intermediate transfer belt 15.

The first transfer parts 10 each have a first transfer roller 16 as an opposite member that is disposed so as to face the photoreceptor 11 with the intermediate transfer belt 15 interposed therebetween. The first transfer roller 16 has a core and a sponge layer as an elastic layer adhering to the circumferential surface of the core. The core is a cylindrical bar made of metal such as iron or SUS. The sponge layer is formed of blended rubber of NBR, SBR, and EPDM, which contains a conductive agent such as a carbon black. The sponge layer is a cylindrical sponge roll having a volume resistivity ranging from $10^{7.5}$ Ωcm to $10^{8.5}$ Ωcm.

The first transfer roller 16 is disposed so as to be pressed against the photoreceptor 11 with the intermediate transfer belt 15 interposed therebetween, and a voltage (first transfer bias) is applied to the first transfer roller 16 in the polarity opposite to the polarity in which the toner has been charged (herein defined as negative polarity, the same holds true for the following description). Accordingly, toner images on the individual photoreceptors 11 are electrostatically drawn to the intermediate transfer belt 15 in sequence, and a composite toner image is formed on the intermediate transfer belt 15.

The second transfer part 20 has the back roller 25 and a second transfer roller 22 disposed so as to face the toner-image-carrying side of the intermediate transfer belt 15.

The surface of the back roller 25 is formed of a tube of blended rubber of EPDM and NBR in which carbon has been dispersed, and the inside thereof is formed of EPDM rubber. The back roller 25 is formed so as to have a surface resistivity ranging from $10^7$Ω/□ to $10^{10}$Ω/□, and the hardness thereof is adjusted to be, for instance, 70° (measured with ASKER Durometer Type C manufactured by Kobunshi Keiki Co., Ltd., the same holds true for the following description). The back roller 25 is disposed so as to face the back side of the intermediate transfer belt 15 and serves as a counter electrode of the second transfer roller 22, and a power-supplying roller 26 made of metal is provided in contact with the back roller 25 to steadily apply a second transfer bias.

The second transfer roller 22 has a core and a sponge layer as an elastic layer adhering to the circumferential surface of the core. The core is a cylindrical bar made of metal such as iron or SUS. The sponge layer is formed of blended rubber of NBR, SBR, and EPDM, which contains a conductive agent such as a carbon black. The sponge layer is a cylindrical sponge roller having a volume resistivity ranging from $10^{7.5}$ Ωcm to $10^{8.5}$ Ωcm.

The second transfer roller 22 is disposed so as to be pressed against the back roller 25 with the intermediate transfer belt 15 interposed therebetween. The second transfer roller 22 is grounded to form a second transfer bias between the back roller 25 and the second transfer roller 22, and thus a toner image is transferred by the second transfer to paper K (example of recording medium) that is to be transported to the second transfer part 20.

An intermediate transfer belt cleaner 35 that removes residual toner and paper dust on the intermediate transfer belt 15 after the second transfer to clean the surface thereof is provided to the intermediate transfer belt 15 downstream of the second transfer part 20 so as to be movable toward and away from the intermediate transfer belt 15.

The intermediate transfer belt 15, the first transfer parts 10 (first transfer rollers 16), and the second transfer part 20 (second transfer roller 22) correspond to an example of the transfer unit.

A reference signal sensor (home position sensor) 42 that generates a reference signal that is the basis for timing formation of images by the image forming units 1Y, 1M, 1C, and 1K is provided upstream of the image forming unit 1Y for yellow. In addition, an image density sensor 43 that adjusts image quality is provided downstream of the image forming unit 1K for black. The reference sensor 42 recognizes a mark provided on the back side of the intermediate transfer belt 15 and then generates a reference signal, and the controller 40 recognizes the reference signal and instructs the image forming units 1Y, 1M, 1C, and 1K to start formation of images.

The image forming apparatus of the exemplary embodiment has a transporting unit for transporting the paper K. The transporting unit includes a paper container 50 in which the paper K is accommodated, a paper feed roller 51 that takes out the paper K gathered in the paper container 50 at a predetermined timing to transport it, transport rollers 52 that transport the paper K taken out by the paper feed roller 51, a transport guide 53 that introduces the paper K transported by the transport rollers 52 to the second transfer part 20, a transport belt 55 that transports the paper K transported after the second transfer by the second transfer roller 22 to the fixing device 60 (example of fixing unit), and a fixing inlet guide 56 that guides the paper K to the fixing device 60.

The controller 40 is a computer that controls the whole apparatus and carries out a variety of operations. In particular, the controller 40 has, for instance, a central processing unit (CPU), a read only memory (ROM) that stores a variety of programs, a random access memory (RAM) used as a working area in execution of the programs, a nonvolatile memory that stores a variety of information, and input and output interfaces (I/O) (each not illustrated). The CPU, ROM, RAM, nonvolatile memory, and I/O are connected to each other via buses.

The image forming apparatus 100 has, in addition to the controller 40, an operation-displaying part, an image-processing part, an image memory, a storage part, and a communication part (each not illustrated). The operation-displaying part, the image-processing part, the image memory, the storage part, and the communication part are each connected to the I/O of the controller 40. The controller 40 exchanges information with the operation-displaying part, the image-processing part, the image memory, the storage part, and the communication part to control each part.

A basic process for forming an image in the image forming apparatus of the exemplary embodiment will now be described.

In the image forming apparatus of the exemplary embodiment, image data output from, for example, an image reader or personal computer (PC) (each not illustrated) is subjected to image processing with an image processor (not illustrated); and then the image forming units 1Y, 1M, 1C, and 1K perform an imaging operation.

The image processor performs image processing including shading compensation, misregistration correction, brightness/color space conversion, gamma correction, and a variety of image editing such as frame elimination, a color edit, and a moving edit on the basis of input data of reflectance. The image data subjected to the image processing is converted to colorant tone data of four colors of Y, M, C, and K and output to the laser exposure unit 13.

In the laser exposure unit 13, an exposure beam Bm emitted from, for example, a semiconductor laser is radiated to the photoreceptor 11 of each of the image forming units 1Y, 1M, 1C, and 1K on the basis of the input colorant tone data. The surfaces of the photoreceptors 11 of the image forming units 1Y, 1M, 1C, and 1K are charged with the charger 12; and the charged surfaces are subjected to scanning exposure with the laser exposure unit 13 to form electrostatic charge images. The formed electrostatic charge images are developed by the image forming units 1Y, 1M, 1C, and 1K into toner images of Y, M, C, and K, respectively.

The toner images formed on the photoreceptors 11 of the image forming units 1Y, 1M, 1C, and 1K are transferred to the intermediate transfer belt 15 at the first transfer parts 10 in which the individual photoreceptors 11 contacts with the intermediate transfer belt 15. More specifically, the first transfer is carried out in the first transfer parts 10 as follows: the first transfer rollers 16 apply voltage (first transfer bias) to the substrate of the intermediate transfer belt 15 in the polarity opposite to the polarity in which toner has been charged (negative polarity), and the toner images are placed one upon another on the surface of the intermediate transfer belt 15 in sequence.

After the toner images are sequentially subjected to the first transfer to the surface of the intermediate transfer belt 15, the intermediate transfer belt 15 moves to transport the toner images to the second transfer part 20. The transportation of the toner images to the second transfer part 20 causes the paper feed roller 51 in the transporting unit to rotate on the basis of the timing of the transportation of the toner images to the second transfer part 20, and paper K with the intended size is supplied from the paper container 50. The paper K supplied by the paper feed roller 51 is transported by the transport rollers 52 and then reaches the second transfer part 20 through the transport guide 53. Before the paper K reaches the second transfer part 20, the paper K is stopped, an alignment roller (not illustrated) rotates on the basis of the timing of the movement of the intermediate transfer belt 15 carrying the toner images to align the position of the paper K with the position of the toner images.

In the second transfer part 20, the second transfer roller 22 is pressed against the back roller 25 with the intermediate transfer belt 15 interposed therebetween. The paper K transported at the right timing enters between the intermediate transfer belt 15 and the second transfer roller 22. At this time, the power supplying roller 26 applies voltage (second transfer bias) in the polarity the same as the polarity in which toner has been charged (negative polarity), and then a transfer electric field is formed between the second transfer roller 22 and the back roller 25. The unfixed toner images carried by the intermediate transfer belt 15 is electrostatically transferred onto the paper K at one time at the second transfer part 20 at which the second transfer roller 22 and the back roller 25 are pressed against each other.

Then, the paper K having the toner images which are electrostatically transferred is transported by the second transfer roller 22 in a state in which it is separated from the intermediate transfer belt 15 and reaches the transport belt 55 provided downstream of the second transfer roller 22 in the direction in which the paper is transported. The transport belt 55 transports the paper K to the fixing device 60 at the optimum transport rate for the fixing device 60. The unfixed toner images on the paper K transported to the fixing device 60 are fixed onto the paper K with heat and pressure in the fixing device 60. The paper K having the fixed image is transported to an ejected paper holder (not illustrated) provided to an ejection part of the image forming apparatus.

After the transfer to the paper K is finished, residual toner on the intermediate transfer belt 15 is transported to the cleaning part by the rotation of the intermediate transfer belt 15 and then removed from the intermediate transfer belt 15 with the cleaning back roller 34 and the intermediate transfer belt cleaner 35.

Fixing Device

Examples of the fixing device 60 will now be described; however, the fixing device 60 is not limited thereto.

First Example of Fixing Device 60

Figure 2:
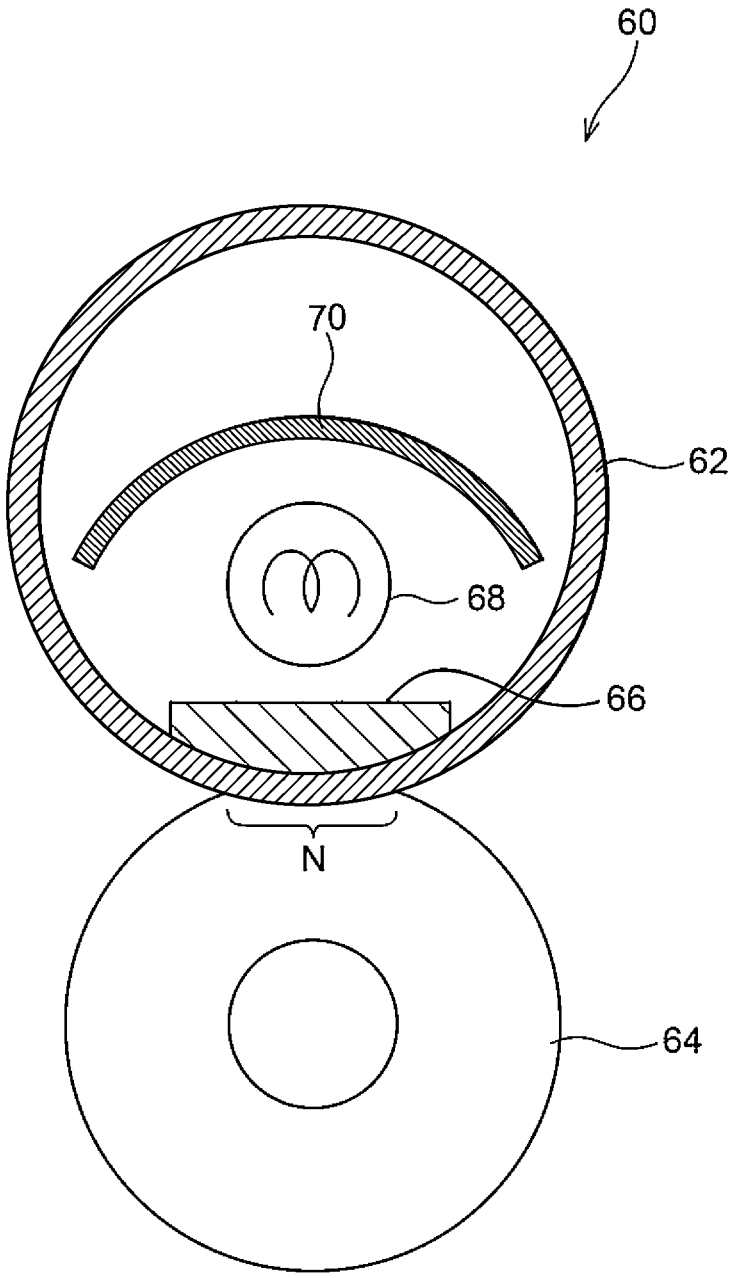
FIG. 2 schematically illustrates an example of the structure of a fixing device used in the exemplary embodiment.

FIG. 2 schematically illustrates the structure of a first example of the fixing device.

With reference to FIG. 2, the first example of the fixing device 60 has a fixing belt 62, a pressure roller 64 (example of rotational member), a pressure pad 66 (example of pressure member), a halogen lamp 68 (example of heater), and a reflection plate 70 (example of reflection member).

The outer surface of the fixing belt 62 contacts with the outer surface of the pressure roller 64 to form a contact area N. Both the fixing belt 62 and the pressure roller 64 rotate to transport the paper K in the contact area.

The fixing belt 62 is a belt that contacts toner images transferred to the surface of the paper K. An example of the fixing belt 62 is an endless belt having a substrate (for example, substrate formed of polyimide resin), an elastic layer (for instance, silicone rubber layer) on the substrate, and a release layer (for example, fluororesin layer) on the elastic layer.

The thickness of the fixing belt 62 is, for instance, from 110 μm to 450 μm (suitably from 110 μm to 430 μm) in terms of a reduction in heat capacity.

The fixing belt 62 is rotatably supported by bearings (not illustrated) at the two ends in the axial direction. One end of the fixing belt 62 in the axial direction is engaged with a drive transmission member (such as gear, not illustrated). The drive transmission member is rotated around the axis by a drive source (such as motor, not illustrated) to rotate the fixing belt 62.

The pressure roller 64 contacts with the outer surface of the fixing belt 62.

The pressure roller 64 is, for example, formed of resin or metal so as to have a cylindrical or columnar shape. Part of the outer surface of the pressure roller 64 is pressed against the pressure pad 66 by an action of an elastic member (such as spring) on a bearing (not illustrated) with the fixing belt 62 interposed therebetween. This structure allows the pressure roller 64 and the fixing belt 62 to form the contact area N (namely, nip). In particular, the pressure roller 64 and the pressure pad 66 serve to pinch the fixing belt 62 (namely, paper K and toner images) to apply pressure thereto in the contact area N.

Insertion members (such as caps, not illustrated) are attached to the two ends of the pressure roller 64 in the axial direction to enhance rigidity against external force in the direction of the diameter of the pressure roller 64. The insertion members are rotatable around the axis owing to bearings (not illustrated). The rotation of the fixing belt 62 drives and rotates the pressure roller 64. This structure enables the pressure roller 64 to rotate together with the fixing belt 62 in the contact area N to transport the paper K.

Another structure in which rotational driving of the pressure roller 64 drives and rotates the fixing belt 62 may be employed.

The pressure pad 66 is provided so as to face the inner surface of the fixing belt 62.

An example of the pressure pad 66 is a columnar member formed of resin or metal.

The pressure roller 64 is pressed against the pressure pad 66 with the fixing belt 62 interposed therebetween, and thus the pressure pad 66 and the pressure roller 64 pinch the fixing belt 62 (namely, paper K and toner images) to apply pressure thereto in the contact area N.

Another structure in which the pressure pad 66 is pressed toward the pressure roller 64 with an elastic member (such as spring) with the fixing belt 62 interposed therebetween may be employed. In other words, the pressure pad 66 may be either a member against which the pressure roller 64 is pressed to apply pressure to the fixing belt 62 or a member that is pushed against the pressure roller 64 to apply pressure to the fixing belt 62.

A pressure member in the form of a roll may be provided in place of the pressure pad 66.

The halogen lamp 68 is provided so as to face the inner surface of the fixing belt 62. Specifically, the halogen lamp 68 is, for example, disposed so as to face the contact area N with the pressure pad 66 interposed therebetween. The halogen lamp 68 directly heats the contact area N.

The halogen lamp 68 is a circular tube extending in the width direction of the fixing belt 62 (direction of rotational axis of belt). The halogen lamp 68 has a heat source that is a filament with small heat capacity and therefore starts radiating heat immediately after the power is turned on.

Any of known heaters such as a ceramic heater and a quartz lamp may be used in place of the halogen lamp 68.

The reflection plate 70 is provided so as to face the inner surface of the fixing belt 62. Specifically, the reflection plate 70 is, for example, disposed so as to face the contact area N with the halogen lamp 68 interposed therebetween.

The reflection plate 70 is, for instance, formed of a planar metal member or a planar resin member having a metal layer formed on the reflection side by vapor deposition. The reflection plate 70 is, for instance, curved such that the contact area N side is recessed.

The reflection plate 70 functions to reflect radiant heat from the halogen lamp 68 toward the contact area N.

In the first example of the fixing device 60, toner images formed on the paper K are pressurized and heated in the contact area N formed by the fixing belt 62 and the pressure roller 64 as described above, thereby fixing the toner images to the paper K. The fixing belt 62 has a small heat capacity, and the halogen lamp 68 directly heats the contact area N; hence, part of the fixing belt 62 other than the contact area N can be easily cooled. Thus, the occurrence of hot offset due to overshoot is readily reduced.

The halogen lamp 68 has a heat source that is a filament with small heat capacity and is therefore a heater that starts radiating heat immediately after the power is turned on. Use of the halogen lamp 68 therefore enables the power-off mode to be prolonged, which readily reduces the occurrence of hot offset due to overshoot.

Use of the reflection plate 70 enables the contact area N to be quickly heated. In particular, use of the reflection plate 70 enables the power-off mode of the halogen lamp 68 to be prolonged, which readily reduces the occurrence of hot offset due to overshoot.

Second Example of Fixing Device 60

Figure 3:
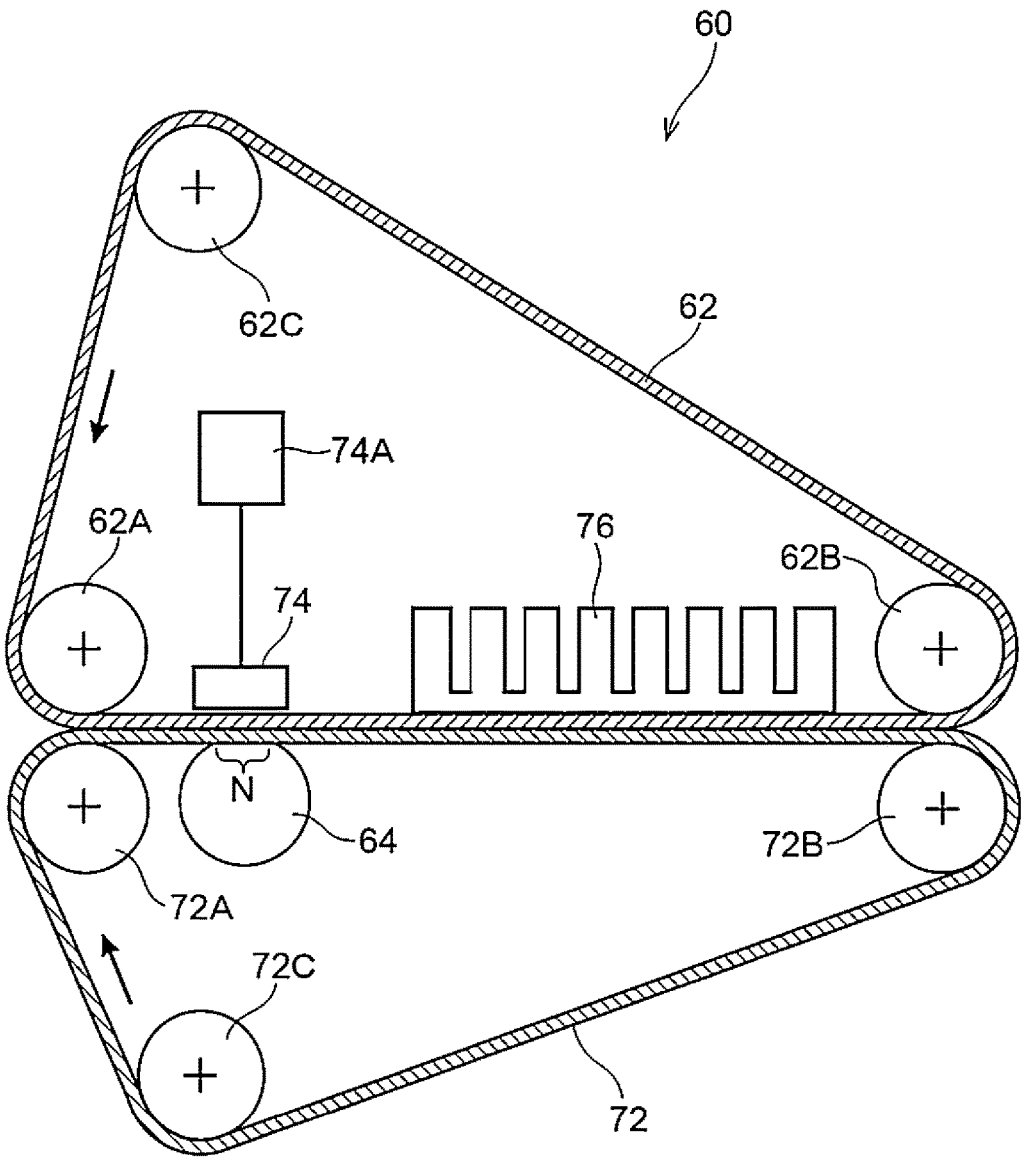
FIG. 3 schematically illustrates another example of the structure of the fixing device used in the exemplary embodiment.

FIG. 3 schematically illustrates the structure of a second example of the fixing device. Members having substantially the same functions as in the first example of the fixing device 60 will be denoted by the same sings, and description thereof will be omitted.

With reference to FIG. 3, the second example of the fixing device 60 includes the fixing belt 62, the pressure roller 64 (example of rotational member), a paper transporting belt 72, a linear heating unit 74 (example of heater and pressure member), a pulse-energizing part 74A, and a heat sink 76 (example of cooling part).

The outer surface of the fixing belt 62 and the outer surface of the pressure roller 64 face each other and contact the paper transporting belt 72 disposed therebetween to form a contact area N. Both the fixing belt 62 and the pressure roller 64 rotate to transport the paper K in the contact area.

In the second example of the fixing device 60, the contact area N refers to the area in which the outer surface of the fixing belt 62 and the outer surface of the pressure roller 64 face each other and contact the paper transporting belt 72 disposed therebetween.

The fixing belt 62 is supported by rotational supporting rollers 62A, 62B, and 62C under tension. Among the three rotational supporting rollers 62A, 62B, and 62C, the rotational supporting roller 62B that is the first one downstream of the linear heating unit 74 in the rotational direction of the fixing belt 62 is a driving roller that rotationally drives the fixing belt 62.

The pressure roller 64 is disposed so as to face the inner surface of the paper transporting belt 72. Part of the outer surface of the pressure roller 64 is pressed against the linear heating unit 74 by an action of an elastic member (such as spring) on a bearing (not illustrated) with the fixing belt 62 and the paper transporting belt 72 interposed therebetween. This structure allows the pressure roller 64 and the fixing belt 62 to form the contact area N (namely, nip) with the paper transporting belt 72 interposed therebetween. In particular, the pressure roller 64 and the linear heating unit 74 pinch the fixing belt 62 and the paper transporting belt 72 (namely, paper K and toner images) to apply pressure thereto in the contact area N.

The paper transporting belt 72 is supported by rotational supporting rollers 72A, 72B, and 72C under tension. The fixing belt 72 is driven and rotated by the rotation of the fixing belt 62.

The rotational supporting rollers 62A and 62B supporting the fixing belt 62 and the rotational supporting rollers 72A and 72B supporting the paper transporting belt 72 are disposed so as to face each other with the fixing belt 62 and the paper transporting belt 72 interposed therebetween, respectively. In other words, the outer surfaces of the fixing belt 62 and paper transporting belt 72 are adjusted so as to face each other between the rotational supporting rollers 62A and 72A and between the rotational supporting rollers 62B and 72B.

The linear heating unit 74 is disposed so as to face the inner surface of the fixing belt 62. In particular, the linear heating unit 74 is disposed so as to face the contact area N. The linear heating unit 74 directly heats the contact area N.

The pressure roller 64 is pressed against the linear heating unit 74 with the fixing belt 62 and the paper transporting belt 72 interposed therebetween, and thus the linear heating unit 74 and the pressure roller 64 pinch the fixing belt 62 (namely, paper K and toner images) to apply pressure thereto in the contact area N.

The linear heating unit 74 is a longitudinal member extending in the width direction of the fixing belt 62 (direction of rotation axis of belt). The linear heating unit 74 is, for instance, a heater having a linear heating part in which multiple heat elements as heat sources have been disposed in line on a substrate. In particular, the linear heating unit 74 is a heating unit to be discriminated from a heating unit formed of a nichrome wire. An example of the linear heating unit 74 is a thermal head.

The pulse-energizing part 74A is a power source and in electrical connection with the linear heating unit 74 to pulse-energize the linear heating unit 74. Specifically, the pulse-energizing part 74A pulse-energizes heat elements.

The form of the energizing pulse applied by the pulse-energizing part 74A is, for example, a rectangular wave, a triangular wave, or a sine wave. Electricity does not need to be turned off between the pulses.

The pulse-energizing part 74A is connected to the controller 40. The controller 40 controls the pulse-energizing part 74A to pulse-energize the linear heating unit 74.

The heat sink 76 is disposed in contact with the inner surface of the fixing belt 62. In particular, the heat sink 76 is, for instance, disposed downstream of the contact area N in the rotational direction of the fixing belt 62.

The heat sink 76 absorbs and radiates the heat of the fixing belt 62 downstream of the heated contact area N in the rotational direction of the fixing belt 62 to cool the fixing belt 62. This enables fixed images formed by fixing of toner images in the contact area N to be cooled.

In the second example of the fixing device 60 that has been described above, the paper K on which toner images have been formed is pressurized and heated in the contact area N formed by the fixing belt 62 and the pressure roller 64 with the paper transporting belt 72 interposed therebetween to fix the toner images to the paper K. Then, the fixed images on the paper K are cooled by the heat sink 76 and subsequently separated from the fixing belt 62.

Since the contact area N is directly heated by the linear heating unit 74, part of the fixing belt 62 other than the contact area N can be easily cooled. Thus, the occurrence of hot offset due to overshoot is readily reduced.

In the linear heating unit 74, the heating region can be divided into multiple sections as in a thermal head, the quantity of the heat can be therefore easily controlled. Hence, the occurrence of hot offset due to overshoot is readily reduced.

The linear heating unit 74 emits heat owing to the pulse-energizing part 74A, and the pulse waveform or pulse intervals in the pulse energizing are adjusted to easily control the temperature of the heat emitted by the linear heating unit 74. This enables an easy reduction in the occurrence of hot offset brought about by overshoot.

A fixed image subjected to fixing in the contact area N is cooled by the heat sink 76 (namely, melted toner in the image becomes solid) and then released from the fixing belt 62. This enables an easy reduction in the occurrence of hot offset. In addition, the heat sink 76 also cools the fixing belt 62, which enables an easy reduction in the occurrence of hot offset brought about by overshoot.

Figure 4:
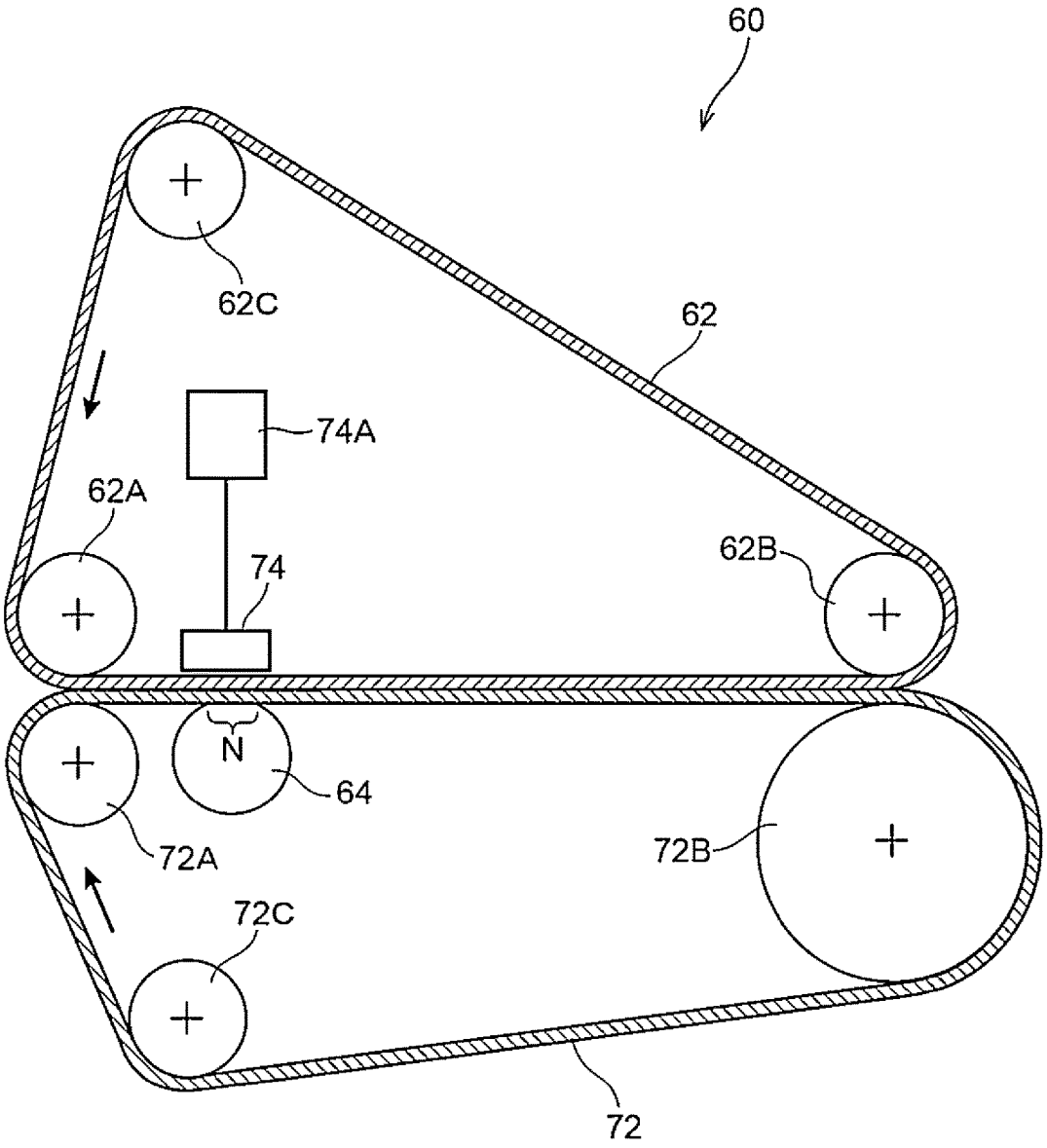
FIG. 4 schematically illustrates another example of the structure of the fixing device used in the exemplary embodiment.

Another structure may be employed, in which the heat sink 76 is not provided and in which the rotational supporting roller 72B supporting the paper transporting belt 72 and disposed at such a position that a fixed image is separated from the fixing belt 62 has a larger diameter to serves as the cooling part (see FIG. 4). An increase in the diameter of the rotational supporting roller 72B (specifically, an increase in the diameter of the rotational supporting roller 72B rather than the diameter of the rotational supporting roller 62B supporting the fixing belt 62) enables the rotational supporting roller 72B to cool a fixed image via the paper transporting belt 72.

Electrostatic Charge Image Developer

An electrostatic charge image developer held in the developing unit of the image forming apparatus of the exemplary embodiment (also referred to as "electrostatic charge image developer used in the exemplary embodiment") will now be described in detail.

The electrostatic charge image developer used in the exemplary embodiment at least contains toner.

The electrostatic charge image developer used in the exemplary embodiment may be a single component developer containing only toner or may be a two component toner containing toner and a carrier.

Toner

The toner contains toner particles. The toner may contain an external additive in addition to the toner particles.

Toner Particles

The toner particles contain, for example, a binder resin. The toner particles may contain a colorant, a release agent, and another additive.

Binder Resin

The binder resin to be used is an amorphous polyester resin.

The amorphous resin herein does not show a clear endothermic peak but show only a step-like endothermic change in a thermal analysis by differential scanning calorimetry (DSC) and that is a solid at normal temperature and thermoplasticized at the glass transition temperature or higher.

In contrast, a crystalline resin does not show a step-like change in the amount of endothermic energy but show a clear endothermic peak in an analysis by differential scanning calorimetry (DSC).

Specifically, for example, the half-value width of the endothermic peak of the crystalline resin is within 10° C. when the analysis is performed at a temperature increase rate of 10° C./min, and the amorphous resin has the half-value width exceeds 10° C. or does not have a clear endothermic peak.

Examples of the amorphous polyester resin include polycondensates of a polycarboxylic acid with a polyhydric alcohol. The amorphous polyester resin may be a commercially available product or may be a synthesized resin.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenylsuccinic acid, adipic acid, and sebacic acid); alicyclic dicarboxylic acids (such as cyclohexanedicarboxylic acid); aromatic dicarboxylic acids (such as terephthalic acid, isophthalic acid, phthalic acid, and naphthalenedicarboxylic acid); anhydrides of the foregoing; and lower alkyl esters (having, for example, from 1 to 5 carbon atoms) of the foregoing. Of these, for example, aromatic dicarboxylic acids are suitable as the polycarboxylic acid.

The polycarboxylic acid may be a combination of the dicarboxylic acid with a carboxylic acid that has three or more carboxy groups and that gives a cross-linked structure or a branched structure. Examples of the carboxylic acid having three or more carboxy groups include trimellitic acid and pyromellitic acid, anhydrides of the foregoing, and lower alkyl esters (having, for example, from 1 to 5 carbon atoms) of the foregoing.

Such polycarboxylic acids may be used alone or in combination.

Examples of the polyhydric alcohol include aliphatic diols (such as ethylene glycol, diethylene glycol, triethylene glycol, propylene glycol, butanediol, hexanediol, and neopentyl glycol); alicyclic diols (such as cyclohexanediol, cyclohexanedimethanol, and hydrogenated bisphenol A); and aromatic diols (such as ethylene oxide adducts of bisphenol A and propylene oxide adducts of bisphenol A). Among these, for example, aromatic diols and alicyclic diols are preferred as the polyhydric alcohol, and aromatic diols are more preferred.

The polyhydric alcohol may be a combination of the diol with a polyhydric alcohol that has three or more hydroxy groups and that gives a cross-linked structure or a branched structure. Examples of the polyhydric alcohol having three or more hydroxy groups include glycerin, trimethylolpropane, and pentaerythritol.

Such polyhydric alcohols may be used alone or in combination.

Alkylene oxide adducts of bisphenol A (such as ethylene oxide adduct of bisphenol A, propylene oxide adduct of bisphenol A, and ethylene oxide-propylene oxide adduct of bisphenol A) are not used as the polyhydric alcohol or used in a slight amount if any. Specifically, in the case where an alkylene oxide adduct of bisphenol A is used, the amount thereof is greater than 0 mol % but not more than 5 mol % relative to the amount of the whole polyhydric alcohol.

The amorphous polyester resin has a glass transition temperature (Tg) ranging preferably from 50° C. to 80° C., and more preferably from 50° C. to 65° C.

The glass transition temperature is determined from a DSC curve obtained by differential scanning calorimetry (DSC) and can be specifically determined in accordance with "Extrapolated Starting Temperature of Glass Transition" described in determination of glass transition temperature in JIS K 7121-1987 "Testing Methods for Transition Temperatures of Plastics".

The amorphous polyester resin has a weight average molecular weight (Mw) ranging preferably from 5000 to 1000000, more preferably from 7000 to 500000, and further preferably from 30000 to 50000.

The amorphous polyester resin suitably has a number average molecular weight (Mn) ranging from 2000 to 100000.

The amorphous polyester resin has a molecular weight distribution Mw/Mn ranging preferably from 1.5 to 100, and more preferably from 2 to 60.

The weight average molecular weight and the number average molecular weight are measured by gel permeation chromatography (GPC). The measurement of the molecular weight by GPC involves using a measurement apparatus that is GPC·HLC-8120GPC manufactured by Tosoh Corporation, a column that is TSK gel Super HM-M (15 cm) manufactured by Tosoh Corporation, and a tetrahydrofuran (THF) solvent. From results of such measurement, the weight average molecular weight and the number average molecular weight are calculated from a molecular weight calibration curve plotted on the basis of a standard sample of monodisperse polystyrene.

The amorphous polyester resin can be produced by any of known techniques. In particular, the amorphous polyester resin is, for example, produced through a reaction at a polymerization temperature ranging from 180° C. to 230° C. optionally under reduced pressure in the reaction system, while water or alcohol that is generated in condensation is removed.

In the case where monomers as the raw materials are not dissolved or compatible at the reaction temperature, a solvent having a high boiling point may be used as a solubilizing agent in order to dissolve the raw materials. In such a case, the polycondensation reaction is performed while the solubilizing agent is distilled away. In the case where monomers having low compatibility are used, such monomers are preliminarily subjected to condensation with an acid or alcohol that is to undergo polycondensation with the monomers, and then the resulting product is subjected to polycondensation with the principle components.

The amount of the amorphous polyester resin is preferably from 60 mass % to 98 mass %, more preferably from 70 mass % to 98 mass %, and further preferably 80 mass % to 98 mass % relative to the amount of the whole binder resin.

The amorphous polyester resin may be used in combination with a crystalline resin. The combined use of a crystalline resin enables the moisture absorption of the toner particles to be lowered and thus leads to an easy reduction in generation of a distorted image due to scattering of the toner. The amount of a crystalline polyester resin to be used may be in the range of 2 mass % to 40 mass % (suitably 2 mass % to 20 mass %) relative to the amount of the whole binder resin.

Examples of the crystalline resin include known crystalline resins such as crystalline polyester resins and crystalline vinyl resins (such as polyalkylene resin and long-chain alkyl(meth)acrylate resin). Among these, crystalline polyester resins are suitable in terms of a reduction in generation of a distorted image due to scattering of the toner.

Examples of the crystalline polyester resin include polycondensates of a polycarboxylic acid with a polyhydric alcohol. The crystalline polyester resin may be a commercially available product or a synthesized resin.

The crystalline polyester resin may be suitably a polycondensate prepared from polymerizable monomers having linear aliphatics rather than a polycondensate prepared from polymerizable monomers having aromatics in terms of easy formation of a crystal structure.

Examples of the polycarboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid); aromatic dicarboxylic acids (e.g., dibasic acids such as phthalic acid, isophthalic acid, terephthalic acid, and naphthalene-2,6-dicarboxylic acid); anhydrides of these dicarboxylic acids; and lower alkyl esters (having, for example, from 1 to 5 carbon atoms) of these dicarboxylic acids.

The polycarboxylic acid may be a combination of the dicarboxylic acid with a carboxylic acid that has three or more carboxy groups and that gives a cross-linked structure or a branched structure. Examples of the carboxylic acid having three carboxy groups include aromatic carboxylic acids (such as 1,2,3-benzenetricarboxylic acid, 1,2,4-benzenetricarboxylic acid, and 1,2,4-naphthalenetricarboxylic acid); anhydrides of these tricarboxylic acids; and lower alkyl esters (having, for example, from 1 to 5 carbon atoms) of these tricarboxylic acids.

The polycarboxylic acid may be a combination of these dicarboxylic acids with a dicarboxylic acid having a sulfonic group or a dicarboxylic acid having an ethylenic double bond.

The polycarboxylic acids may be used alone or in combination.

Examples of the polyhydric alcohol include aliphatic diols (such as linear aliphatic diols having a backbone with from 7 to 20 carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol are suitable.

The polyhydric alcohol may be a combination of the diol with an alcohol that has three or more hydroxy groups and that gives a cross-linked structure or a branched structure. Examples of the alcohol having three or more hydroxy groups include glycerin, trimethylolethane, trimethylolpropane, and pentaerythritol.

The polyhydric alcohols may be used alone or in combination.

The aliphatic diol content in the polyhydric alcohol may be 80 mol % or more, and suitably 90 mol % or more.

The melting temperature of the crystalline polyester resin is preferably from 50° C. to 100° C., more preferably from 55° C. to 90° C., and further preferably from 60° C. to 85° C.

The melting temperature is determined from a DSC curve obtained by differential scanning calorimetry (DSC) in accordance with "Melting Peak temperature" described in determination of melting temperature in JIS K 7121-1987 "Testing Methods for Transition Temperatures of Plastics".

The weight average molecular weight (Mw) of the crystalline polyester resin is suitably from 6,000 to 35,000.

The crystalline polyester resin can be, for example, produced by any of known techniques as in production of the amorphous polyester resin.

The amount of the crystalline resin (suitably crystalline polyester resin) is preferably from 3 mass % to 20 mass %, and more preferably from 5 mass % to 15 mass % relative to the amount of the whole toner. The amount of the crystalline resin in such a range enables an easy reduction in generation of a distorted image due to scattering of the toner.

Another binder resin different from the amorphous polyester resin and the crystalline resin may be used in combination as the binder resin. The amount of such another resin is suitably 10 mass % or less relative to the amount of the whole binder resin.

Examples of such another binder resin include vinyl resins that are homopolymers of monomers such as styrenes (such as styrene, p-chlorostyrene, and α-methylstyrene), (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene) or copolymers of two or more of these monomers.

Other examples of such another binder resin include non-vinyl resins such as epoxy resins, polyurethane resins, polyamide resins, cellulose resins, polyether resins, and modified rosin; mixtures thereof with the above-mentioned vinyl resins; and graft polymers obtained by polymerization of a vinyl monomer in the coexistence of such non-vinyl resins.

The amount of the binder resin is, for instance, preferably from 40 mass % to 95 mass %, more preferably from 50 mass % to 90 mass %, and further preferably from 60 mass % to 85 mass % relative to the amount of the whole toner particles.

Colorant

Examples of the colorant include a variety of pigments, such as carbon black, chrome yellow, Hansa Yellow, benzidine yellow, indanthrene yellow, quinoline yellow, pigment yellow, permanent orange GTR, pyrazolone Orange, Vulcan Orange, Watchung Red, Permanent Red, Brilliant Carmine 3B, Brilliant Carmine 6B, Du Pont Oil Red, pyrazolone red, lithol red, rhodamine B lake, lake red C, pigment red, rose bengal, aniline blue, ultramarine blue, chalco oil blue, methylene blue chloride, phthalocyanine blue, pigment blue, phthalocyanine green, and malachite green oxalate, and a variety of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination.

The colorant may be optionally a surface-treated colorant or may be used in combination with a dispersant. Different types of colorants may be used in combination.

The amount of the colorant is, for instance, preferably from 1 mass % to 30 mass %, and more preferably from 3 mass % to 15 mass % relative to the amount of the whole toner particles.

Release Agent

Examples of a release gent include, but are not limited to, hydrocarbon waxes; natural waxes such as a carnauba wax, a rice bran wax, and a candelilla wax; synthetic or mineral/ petroleum waxes such as a montan wax; and ester waxes such as a fatty acid ester and a montanic acid ester.

The melting temperature of the release agent is preferably from 50° C. to 110° C., and more preferably from 60° C. to 100° C.

The melting temperature is determined from a DSC curve obtained by differential scanning calorimetry (DSC) in accordance with "Melting Peak temperature" described in determination of melting temperature in JIS K 7121-1987 "Testing Methods for Transition Temperatures of Plastics".

The amount of the release agent is, for example, preferably from 1 mass % to 20 mass %, and more preferably from 5 mass % to 15 mass % relative to the amount of the whole toner particles.

Other Additives

Examples of other additives include known additives such as a magnetic material, a charge-controlling agent, and inorganic powder. These additives are contained in the toner particles as internal additives.

Characteristics of Toner Particles

In the case where the toner particles are analyzed by infrared absorption spectrometry, the ratio of absorbance for a wavelength of 1500 $cm^{-1}$ to absorbance for a wavelength of 720 $cm^{-1}$ is 0.6 or less (preferably 0.5 or less, and more preferably 0.48 or less), and the ratio of absorbance for a wavelength of 820 $cm^{-1}$ to absorbance for a wavelength of 720 $cm^{-1}$ is 0.4 or less (preferably 0.3 or less, and more preferably 0.2 or less).

The toner particles exhibit such infrared absorption spectrum characteristics when the polyhydric alcohol component contained in the amorphous polyester resin as the binder resin does not contain an alkylene oxide adduct of bisphenol A or contain it in a slight amount if any as described above.

In the analysis of the toner particles by infrared absorption spectrometry, the ratio of absorbance for a wavelength of 1500 $cm^{-1}$ to absorbance for a wavelength of 720 $cm^{-1}$ may be 0.2 or more (suitably 0.3 or more), and the ratio of absorbance for a wavelength of 820 $cm^{-1}$ to absorbance for a wavelength of 720 $cm^{-1}$ is 0.05 or more (suitably 0.08 or more) in terms of the storage stability of the toner.

In the analysis of the toner particles by infrared absorption spectrometry, the ratio of absorbance for a wavelength of 820 $cm^{-1}$ to absorbance for a wavelength of 1500 $cm^{-1}$ may be 0.5 or less (preferably 0.4 or less, and more preferably 0.35 or less) in terms of the strength of the toner particles.

In the analysis of the toner particles by infrared absorption spectrometry, the ratio of absorbance for a wavelength of 820 $cm^{-1}$ to absorbance for a wavelength of 1500 $cm^{-1}$ may be 0.1 or more (suitably 0.15 or more) in terms of the storage stability of the toner.

The absorbance for the individual wavelengths is measured by infrared absorption spectrometry as follows. Toner particles (or toner) that are to be analyzed are formed into a test sample by a KBr pellet technique. The test sample analyzed in the wavelength range of 500 $cm^{-1}$ to 4000 $cm^{-1}$ with an infrared spectrophotometer (FT-IR-410 manufactured by JASCO Corporation) at number of integration of 300 times and resolution of 4 $cm^{-1}$. Baseline correction is carried out at, for instance, an offset part having no light absorption to determine the absorbance for the individual wavelengths.

In the case where the THF-soluble component of the toner particles is subjected to a GPC analysis to determine a weight average molecular weight Mw and a number average molecular weight Mn, Mw is from 25000 to 60000 (preferably from 30000 to 50000, and more preferably from 32000 to 48000), and Mw/Mn is from 5 to 10 (preferably from 6 to 8, and more preferably from 6.2 to 7.8).

Such molecular weight characteristics of the toner particles enable an enhancement in the fixing properties of a fixed image even in the case of using the toner of which the toner particles contain the amorphous polyester resin in which an alkylene oxide adduct of bisphenol A is not used or used in a slight amount as described above.

The peak molecular weight in the molecular weight distribution curve obtained by the GPC analysis of the THF-soluble component of the toner particles is preferably from 7000 to 11000, more preferably from 8000 to 11000, and further preferably from 8200 to 10500.

At a peak molecular weight in such a range, the fixing properties of a fixed image can be easily enhanced even in the case of using the toner of which the toner particles contain the amorphous polyester resin in which an alkylene oxide adduct of bisphenol A is not used or used in a slight amount.

In the case where a molecular weight distribution curve obtained by the GPC analysis of the THF-soluble component of the toner particles has multiple peaks, the term "peak molecular weight" refers to the molecular weight at the highest peak.

In the GPC analysis of the THF-soluble component of the toner particles, the molecular weight distribution curve, the average molecular weights, and the peak molecular weight are determined as follows.

Into 1 g of tetrahydrofuran (THF), 0.5 mg of toner particles (or toner) that are to be analyzed are dissolved. The solution is subjected to ultrasonic dispersion, the concentration of the toner particles is adjusted to be 0.5%, and then the dissolved component thereof is analyzed by GPC.

A GPC apparatus to be used is "HLC-8120GPC, SC-8020 (manufactured by Tosoh Corporation)", two columns of "TSKgel, SuperHM-H (manufactured by Tosoh Corporation, 6.0 mm ID×15 cm)" are used, and THF is used as an eluent. The concentration of the sample is 0.5%, the flow rate is 0.6 ml/min, the injection amount of the sample is 10 μl, the measurement temperature is 40° C., and a refractive index (RI) detector is used. The calibration curve is determined from 10 samples of "polystyrene standard sample of TSK standard" manufactured by Tosoh Corporation: "A-500", "F-1", "F-10", "F-80", "F-380", "A-2500", "F-4", "F-40", "F-128", and "F-700".

The amount of the toluene-insoluble component of the toner particles is preferably from 25 mass % to 45 mass %, more preferably from 28 mass % to 38 mass %, and further preferably from 30 mass % to 35 mass %.

At an amount of the toluene-insoluble component of the toner particles in such a range, the moisture absorption of the toner particles is lowered, which leads to an easy reduction in generation of a distorted image due to scattering of the toner.

The toluene-insoluble component of the toner particles refers to the component that is contained in the toner particles but not dissolved in toluene. In other words, the toluene-insoluble component is an insoluble matter of which the principle component (for instance, 50 mass % or more of the whole) is a component of the binder resin that is not dissolved in toluene (particularly high-molecular-weight component of binder resin). The amount of the toluene-insoluble component can be an index of the cross-linked resin content in the toner.

The amount of the toluene-insoluble component is measured as follows.

Toner particles (or toner) weighed to 1 g is put into weighed cylindrical filter paper made of glass fibers, and this cylindrical filter paper is attached to the extraction tube of a thermal Soxhlet extractor. Toluene is put into a flask and heated to 110° C. with a mantle heater. A heater attached to the extraction tube is used to heat the surrounding of the extraction tube to 125° C. The extraction is performed at such a reflux rate that a single cycle of extraction is in the range of four minutes to five minutes. After the extraction is performed for 10 hours, the cylindrical paper filter and residual toner are retrieved, dried, and weighed.

Then, the amount (mass %) of the toner particle residue (or toner residue) is calculated on the basis of the following equation and defined as the amount of the toluene-insoluble component (mass %).

amount (mass %) of toner particle residue (or toner residue)=[(weight of cylindrical filter paper+weight of residual toner) (g)−weight of cylindrical filter paper (g)]÷mass (g) of toner particles (or toner)×100 Equation:

The toner particle residue (or toner residue) contains, for example, a colorant, an inorganic substance such as an external additive, and the high-molecular-weight component of the binder resin. In the case where toner particles contain a release agent, the release agent is a toluene-soluble component because the extraction is carried out through heating.

The toluene-insoluble component of the toner particles is, for example, adjusted by (1) adding a cross-linking agent to a high-molecular-weight component having a reactive functional group at its end to form a cross-linked structure or a branched structure in the binder resin, (2) using a polyvalent metal ion in the binder resin to form a cross-linked structure or a branched structure in a high-molecular-weight component having an ionic functional group at its end, and (3) using, for instance, isocyanate in the binder resin to extend the chain structure of the resin or to allow it to branch.

The toner particles may have a monolayer structure or may have a core shell structure including a core (core particle) and a coating layer (shell layer) that covers the core.

The toner particles having a core shell structure, for instance, properly include a core containing the binder resin and optionally an additive, such as a colorant or a release agent, and a coating layer containing the binder resin.

The volume average particle size (D50v) of the toner particles is preferably from 2 μm to 10 μm, and more preferably from 4 μm to 8 μm.

The average particle size of the toner particles and the index of the particle size distribution thereof are measured with COULTER MULTISIZER II (manufactured by Beckman Coulter, Inc.) and an electrolyte that is ISOTON-II (manufactured by Beckman Coulter, Inc.).

In the measurement, from 0.5 mg to 50 mg of a test sample is added to 2 ml of an aqueous solution of a 5% surfactant (suitably sodium alkylbenzene sulfonate) as a dispersant. This product is added to from 100 ml to 150 ml of the electrolyte.

The electrolyte suspended with the sample is subjected to dispersion for 1 minute with an ultrasonic disperser and then subjected to the measurement of the particle size distribution of particles having a particle size ranging from 2 μm to 60 μm using COULTER MULTISIZER II with an aperture having an aperture diameter of 100 μm. The number of sampled particles is 50,000.

Cumulative distributions by volume and by number are drawn from the smaller diameter side in particle size ranges (channels) into which the measured particle size distribution is divided. The particle size for a cumulative percentage of 16% is defined as a volume particle size D16v and a number particle size D16p, while the particle size for a cumulative percentage of 50% is defined as a volume average particle size D50v and a number average particle size D50p. Furthermore, the particle size for a cumulative percentage of 84% is defined as a volume particle size D84v and a number particle size D84p.

From these particle sizes, the index of the volume particle size distribution (GSDv) is calculated as $(D84v/D16v)^{1/2}$, while the index of the number particle size distribution (GSDp) is calculated as $(D84p/D16p)^{1/2}$.

The average circularity of the toner particles is preferably from 0.94 to 1.00, and more preferably from 0.95 to 0.98.

The average circularity of the toner particles is determined from (circle-equivalent circumference)/(circumference)[circumference of circle having the same projection area as image of particle]/(circumference of projection image of particle)]. In particular, the average circularity of the toner particles is determined as follows.

The toner particles that are to be analyzed are collected by being sucked and allowed to flow in a flat stream. An image of the particles is taken as a still image by instant emission of stroboscopic light and then analyzed with a flow particle image analyzer (FPIA-3000 manufactured by SYSMEX CORPORATION). The number of samples used to determine the average circularity is 3500.

In the case where the toner contains an external additive, the toner (developer) to be analyzed is dispersed in water containing a surfactant and then subjected to an ultrasonic treatment to obtain toner particles having no external additive content.

External Additives

Examples of external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles as an external additive may be hydrophobized. The hydrophobization is performed by, for example, immersing the inorganic particles in a hydrophobizing agent. The hydrophobizing agent is not particularly limited; and examples thereof include silane coupling agents, silicone oils, titanate coupling agents, and aluminum coupling agents. These may be used alone or in combination The amount of the hydrophobizing agent is, for instance, generally from 1 part by mass to 10 parts by mass relative to 100 parts by mass of the inorganic particles.

Examples of the external additives also include resin particles [resin particles such as polystyrene particles, polymethyl methacrylate (PMMA) particles, and melamine resin particles] and cleaning aids (for instance, metal salts of higher fatty acids, such as zinc stearate, and particles of a high-molecular-weight fluorine material).

The amount of the external additive to be used is, for example, preferably from 0.01 mass % to 5 mass %, and more preferably from 0.01 mass % to 2.0 mass % relative to the amount of the toner particles.

Production of Toner

Production of the toner used in the exemplary embodiment will now be described.

The toner used in the exemplary embodiment can be produced by preparing toner particles and then externally adding an external additive to the toner particles.

The toner particles may be produced by any of a dry process (such as kneading pulverizing method) and a wet process (such as aggregation coalescence method, suspension polymerization method, or dissolution suspension method). Production of the toner particles is not particularly limited to these production processes, and any of known techniques can be employed.

The toner used in the exemplary embodiment is produced, for example, by adding an external additive to produced toner particles being in a dried state and then mixing them with each other. The mixing may be carried out, for instance, with a V blender, a HENSCHEL MIXER, or a Loedige mixer. Furthermore, a vibratory sieving machine or a wind sieving machine may be optionally used to remove the coarse particles of the toner.

Carrier

A carrier is not particularly limited, and any of known carriers can be used. Examples of the carrier include coated carriers in which the surface of a core formed of magnetic powder have been coated with a coating resin, magnetic powder dispersed carriers in which magnetic powder has been dispersed in or blended with a matrix resin, and resin impregnated carriers in which porous magnetic powder has been impregnated with resin.

In the magnetic powder dispersed carriers and the resin impregnated carriers, the constituent particles may have a surface coated with a coating resin.

Examples of the magnetic powder include magnetic metals, such as iron, nickel, and cobalt, and magnetic oxides such as ferrite and magnetite.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing an organosiloxane bond or a modified product thereof, fluororesins, polyester, polycarbonate, phenol resins, and epoxy resins.

The coating resin and the matrix resin may contain other additives such as conductive particles.

Examples of the conductive particles include particles of metals such as gold, silver, and copper; carbon black particles; titanium oxide particles; zinc oxide particles; tin oxide particles; barium sulfate particles; aluminum borate particles; and potassium titanate particles.

An example of the preparation of the coating carrier involves coating with a coating-layer-forming solution in which the coating resin and optionally a variety of additives have been dissolved in a proper solvent. The solvent is not particularly limited and may be determined in view of, for instance, the type of coating resin to be used and coating suitability.

Specific examples of the technique for coating method include a dipping method of dipping the core into the coating layer forming solution, a spray method of spraying the coating layer forming solution onto the surface of the core, a fluid-bed method of spraying the coating layer forming solution to the core in a state of being floated by the flowing air, and a kneader coating method of mixing the core of the carrier with the coating layer forming solution in the kneader coater and removing a solvent.

The mixing ratio (mass ratio) of the toner to the carrier in the two component developer (toner:carrier) is preferably from 1:100 to 30:100, and more preferably from 3:100 to 20:100.

EXAMPLES

The exemplary embodiment of the invention will now be further specifically described in detail with reference to Examples and Comparative Examples but is not limited thereto at all.

Preparation of Amorphous Polyester Resin

Preparation of Amorphous Polyester Resin (A1)

60 parts by mass of dimethyl terephthalate, 74 parts by mass of dimethyl fumarate, 30 parts by mass of dodecenylsuccinic anhydride, 22 parts by mass of trimellitic acid, 138 parts by mass of propylene glycol, and 0.3 parts by mass of dibutyltin oxide are put into a three-neck flask of which the inside has been dried. The mixture is reacted at 185° C. for 3 hours under nitrogen atmosphere while removing water generated during the reaction to the outside. Then, the temperature up to 240° C. while the pressure is gradually reduced, and the resulting product is further reacted for 4 hours and then cooled. Through this process, an amorphous polyester resin (A1) having a weight average molecular weight of 39000 is prepared.

Preparation of Amorphous Polyester Resin (A2)

An amorphous resin (A2) is prepared in the same manner as in the preparation of the amorphous resin (A1) except the reaction is performed at 190° C. for 3 hours, then, the temperature up to 220° C. while the pressure is gradually reduced, and the resulting product is further reacted for 2.5 hours. The weight average molecular weight of the amorphous polyester resin (A2) is 26000.

Preparation of Amorphous Polyester Resin (A3)

An amorphous resin (A3) is prepared in the same manner as in the preparation of the amorphous resin (A1) except the component composition are changed to 128 parts by mass of propylene glycol and 19 parts by mass of butylene glycol. The reaction is performed at 195° C. for 4 hours. Then, the temperature up to 240° C. while the pressure is gradually reduced, and the resulting product is further reacted for 6 hours. The weight average molecular weight of the amorphous polyester resin (A3) is 56000.

Preparation of Crystalline Resin

Preparation of Crystalline Polyester Resin (B1)

100 parts by mass of dimethyl sebacate, 67.8 parts by mass of hexanediol, and 0.10 parts by mass of dibutyltin oxide are put into a three-neck flask. The content is reacted at 185° C. for 5 hours under nitrogen atmosphere while removing water generated in the reaction to the outside. Then, the temperature up to 220° C. while the pressure is gradually reduced, and the resulting product is further reacted for 6 hours and then cooled. Through this process, a crystalline polyester resin (B1) having a weight average molecular weight of 33700 is prepared.

The melting temperature of the crystalline polyester resin (B1) is determined from a DSC curve obtained by differential scanning calorimetry (DSC) in accordance with "Melting Peak temperature" described in determination of melting temperature in JIS K 7121-1987 "Testing Methods for Transition Temperatures of Plastics". The melting temperature is 71° C.

Preparation of Referential Amorphous Polyester Resin

Preparation of Referential Amorphous Polyester Resin (C1)

An amorphous resin (C1) is prepared in the same manner as in the preparation of the amorphous resin (A1) except the component composition are changed to 60 parts by mass of dimethyl terephthalate, 74 parts by mass of dimethyl fumarate, 30 parts by mass of dodecenylsuccinic anhydride, 22 parts by mass of trimellitic acid, 137 parts by mass of an ethylene oxide adduct of bisphenol A, 191 parts by mass of a propylene oxide adduct of bisphenol A, and 0.3 parts by mass of dibutyltin oxide are used. The weight average molecular weight of the referential amorphous polyester resin (C1) is 27000.

Production of Toner

Production of Toner (1)

73 parts by mass of the amorphous polyester resin (A1), 6 parts by mass of the crystalline polyester resin (B1), 7 parts by mass of a colorant (C.I. Pigment Red 122), 5 parts by mass of a release agent (paraffin wax manufactured by NIPPON SEIRO CO., LTD., melting temperature of 73° C.), and 2 parts by mass of ester wax (behenyl behenate, UNISTER M-2222SL manufactured by NOF CORPORATION) are put into a HENSCHEL MIXER (manufactured by NIPPON COKE & ENGINEERING CO., LTD.). The mixture is stirred and mixed at a rotational speed of 15 m/s for 5 minutes, and the resulting mixture is melt-kneaded with an extruder-type continuous kneader.

In the extruder-type continuous kneader, the temperature is 160° C. on the supply side and 130° C. on the discharge side, the temperature of a cooling roller is 40° C. on the supply side and 25° C. on the discharge side. The temperature of a cooling belt is adjusted to be 10° C.

The melt-kneaded product is cooled, then roughly pulverized with a hammer mill, and subsequently finely pulverized with a jet-type pulverizer (manufactured by Nippon Pneumatic Mfg. Co., Ltd.) to 6.5 μm. The resulting product is classified with an elbow-jet classifier (type: EJ-LABO, manufactured by Nittetsu Mining Co., Ltd.) to yield toner particles (1). The toner particles (1) have a volume average particle size of 7.0 μm.

Then, 100 parts by mass of the toner particles (1) and 1.2 parts by mass of an external additive that is a commercially available fumed silica RX50 (manufactured by NIPPON AEROSIL CO., LTD.) are mixed with each other with a HENSHEL MIXER (manufactured by MITSUI MIIKE MACHINERY Co., Ltd.) at a rotational speed of 30 m/s for 5 minutes, thereby obtaining toner (1).

Production of Toner (2)

A toner (2) is prepared in the same manner as in the preparation of the toner (1) except that the amorphous polyester resin (A2) is used in place of the amorphous polyester resin (A1). The toner particles (2) have a volume average particle size of 6.8 μm.

Except that the toner particles (2) replaced the toner particles (1), toner (2) is produced as in the production of the toner (1).

Production of Toner (3)

A toner (3) is prepared in the same manner as in the preparation of the toner (1) except that the amorphous polyester resin (A3) is used in place of the amorphous polyester resin (A1). The toner particles (3) have a volume average particle size of 7.5 μm.

Except that the toner particles (3) replaced the toner particles (1), toner (3) is produced as in the production of the toner (1).

Production of Toner (4)

A toner (4) is prepared in the same manner as in the preparation of the toner (1) except that the amount of the amorphous polyester resin (A1) is changed to 79 parts by mass and the crystalline polyester resin (B1) is not used. The toner particles (4) have a volume average particle size of 7.1 μm.

Except that the toner particles (4) replaced the toner particles (1), toner (4) is produced as in the production of the toner (1).

Production of Referential Toner (C1)

A toner (C1) is prepared in the same manner as in the preparation of the toner (4) except that the referential amorphous polyester resin (C1) is used in place of the amorphous polyester resin (A1). The referential toner particles (C1) have a volume average particle size of 7.7 μm.

Except that the referential toner particles (C1) replaced the toner particles (1), toner (C1) is produced as in the production of the toner (1).

Production of Developer

Developers (1) to (4) and Referential Developer (C1)

With 100 parts by mass of a carrier, 8 parts by mass of the individual toners are separately mixed to produce developers (1) to (4) and a referential developer (C1).

In order to produce the carrier, 14 parts by mass of toluene and 2 parts by mass of a styrene-methyl methacrylate copolymer (component ratio: styrene/methyl methacrylate=90/10, weight average molecular weight Mw: 80000) are stirred for 10 minutes with a stirrer to prepare a coating liquid in which these materials have been dispersed. The coating liquid and 100 parts by mass of ferrite particles (volume average particle size: 50 μm) are put into a vacuum degassing kneader (manufactured by INOUE MFG., INC.) and stirred at 60° C. for 30 minutes. Then, the pressure is reduced for degassing under heating to dry the resulting product, and the dried product is filtered with a 105-μm sieve to yield the carrier.

Examples A1 to A4

An image forming apparatus is prepared by modifying an image forming apparatus (trade name "VERSANT 80 PRESS", manufactured by Fuji Xerox Co., Ltd.).

This image forming apparatus has a structure similar to the structure illustrated in FIG. 2 and is modified to have a fixing device in which a halogen lamp directly heats the contact area formed by a pressure roller and a fixing belt having a thickness of 350 μm.

The developers shown in Table 1 are individually placed in the developing device of the image forming apparatus.

Examples B1 to B4

An image forming apparatus is prepared by modifying an image forming apparatus (trade name "VERSANT 80 PRESS", manufactured by Fuji Xerox Co., Ltd.).

This image forming apparatus has a structure similar to the structure illustrated in FIG. 3 and modified to have a fixing device in which a linear heater (thermal head) directly heats a contact area formed by a pressure roller and a fixing belt having a thickness of 350 μm and in which a fixed image is released from the fixing belt after a toner image is heated and pressed and subsequently cooled.

The developers shown in Table 1 are individually placed in the developing device of the image forming apparatus.

Comparative Examples 1 to 4 and Reference Example

An image forming apparatus that is an image forming apparatus (trade name "DPC620", manufactured by Fuji Xerox Co., Ltd.) is prepared.

This image forming apparatus includes a two-roller fixing device having a fixing roller and a pressure roller.

The developers shown in Table 1 are individually placed in the developing device of the image forming apparatus.

Analyses

Each of Examples, Comparative Examples, and Reference Example are subjected to analysis of the molecular weight characteristics of the toner particles, analysis of the infrared absorption spectrum characteristics of the toner particles, and analysis of the toluene-insoluble component in the manners described above. Table 1 shows results of the analyses.

Evaluations

Fixing Properties

Fixing properties are evaluated as follows.

A patch of a non-fixed image which has a size of 4 cm×5 cm and in which the toner is to be used in an amount of 4.0 g/m$^2$ is formed on J paper (A4 size). This patch is printed at a fixed processing speed of 140 mm/s, and the printed image is fixed with fixing temperature being changed by 5° C. from 80° C. to 180° C. The lowest temperature at which offset does not occur (lowest fixing temperature) is determined and evaluated as follows.

Evaluation criteria are as follows.

A: The lowest fixing temperature is lower than 100° C.

B: The lowest fixing temperature is 100° C. or more but lower than 110° C.

C: The lowest fixing temperature is 110° C. or more but lower than 120° C.

Hot offset is evaluated as follows. The evaluation is carried out under a high-temperature and high-humidity environment (temperature of 35° C. and humidity of 85%).

A patch of a non-fixed image which has a size of 4 cm×5 cm and in which the toner is to be used in an amount of 4.0 g/m$^2$ is formed on J paper (A4 size). This patch is printed at a fixed processing speed of 140 mm/s, and the printed image is fixed with fixing temperature being changed by 5° C. from 160° C. to 200° C. The lowest temperature at which hot offset occurs is determined as hot-offset-occurring temperature. In the case where hot offset does not occur at 200° C., the hot-offset-occurring temperature is determined as 200° C. or more.

TABLE 1

| | Developer (toner) | | | | | | | |
|---|---|---|---|---|---|---|---|---|
| | | | Molecular weight characteristics of toner particles | | | | Infrared absorption spectrum characteristics of toner particles | |
| | Type | Binder resin | Mw | Mn | Mw/Mn | Peak molecular weight | Absorbance A for wavelength of 1500 cm$^{-1}$ | Absorbance B for wavelength of 820 cm$^{-1}$ |
| Example A1 | (1) | (A1) + (B1) | 37000 | 5000 | 7.4 | 9500 | 0.07 | 0.02 |
| Example A 2 | (2) | (A2) + (B1) | 25000 | 3000 | 8.3 | 7000 | 0.12 | 0.04 |
| Example A 3 | (3) | (A3) + (B1) | 60000 | 8500 | 7.1 | 11000 | 0.05 | 0.02 |
| Example A 4 | (4) | (A1) | 39000 | 4500 | 8.7 | 9800 | 0.08 | 0.02 |
| Example B1 | (1) | (A1) + (B1) | 37000 | 5000 | 7.4 | 9500 | 0.07 | 0.02 |
| Example B2 | (2) | (A2) + (B1) | 25000 | 3000 | 8.3 | 7000 | 0.12 | 0.04 |
| Example B3 | (3) | (A3) + (B1) | 60000 | 8500 | 7.1 | 11000 | 0.05 | 0.02 |
| Example B4 | (4) | (A1) | 39000 | 4500 | 8.7 | 9800 | 0.08 | 0.02 |
| Comparative Example 1 | (1) | (A1) + (B1) | 37000 | 5000 | 7.4 | 9500 | 0.07 | 0.02 |
| Comparative Example 2 | (2) | (A2) + (B1) | 25000 | 3000 | 8.3 | 7000 | 0.12 | 0.04 |
| Comparative Example 3 | (3) | (A3) + (B1) | 60000 | 8500 | 7.1 | 11000 | 0.05 | 0.02 |
| Comparative Example 4 | (4) | (A1) | 39000 | 4500 | 8.7 | 9800 | 0.08 | 0.02 |
| Reference Example | (C1) | (C1) | 27000 | 5000 | 5.4 | 7500 | 0.90 | 0.50 |

| | Developer (toner) | | | | | | | |
|---|---|---|---|---|---|---|---|---|
| | Infrared absorption spectrum characteristics of toner particles | | | | Toluene-insoluble | | | |
| | Absorbance C for wavelength of 720 cm$^{-1}$ | A/C | B/C | B/A | component of toner particles (mass %) | Image forming apparatus (name of apparatus) | Evaluations | |
| | | | | | | | Fixing properties | Hot offset |
| Example A1 | 0.15 | 0.47 | 0.13 | 0.29 | 34.00 | Modified Versant 80 Press | B | 195 |
| Example A 2 | 0.20 | 0.60 | 0.20 | 0.33 | 28.00 | Modified Versant 80 Press | A | 190 |
| Example A 3 | 0.11 | 0.45 | 0.18 | 0.40 | 38.00 | Modified Versant 80 Press | C | 200 |
| Example A 4 | 0.14 | 0.57 | 0.14 | 0.25 | 33.00 | Modified Versant 80 Press | B | 200 |
| Example B1 | 0.15 | 0.47 | 0.13 | 0.29 | 34.00 | Modified Versant 80 Press | B | 200 |
| Example B2 | 0.20 | 0.60 | 0.20 | 0.33 | 28.00 | Modified Versant 80 Press | A | 200 |
| Example B3 | 0.11 | 0.45 | 0.18 | 0.40 | 38.00 | Modified Versant 80 Press | C | 200 |
| Example B4 | 0.14 | 0.57 | 0.14 | 0.25 | 33.00 | Modified Versant 80 Press | B | 200 |
| Comparative Example 1 | 0.15 | 0.47 | 0.13 | 0.29 | 34.00 | DPC620 | A | 185 |
| Comparative Example 2 | 0.20 | 0.60 | 0.20 | 0.33 | 28.00 | DPC620 | A | 180 |

TABLE 1-continued

| | | | | | | | | |
|---|---|---|---|---|---|---|---|---|
| Comparative Example 3 | 0.11 | 0.45 | 0.18 | 0.40 | 38.00 | DPC620 | B | 195 |
| Comparative Example 4 | 0.14 | 0.57 | 0.14 | 0.25 | 33.00 | DPC620 | B | 190 |
| Reference Example | 0.30 | 3.00 | 1.67 | 0.56 | 31.00 | DPC620 | B | 200 |

The results show that the occurrence of hot offset in a high-temperature and high-humidity environment is reduced in the image forming apparatus of each of Examples in which a specific toner and a fixing belt are used and which includes a fixing device in which a heater directly heats the contact area formed by the fixing belt and the pressure roller rather than in the image forming apparatus of each of Comparative Examples which includes the two-roller fixing device.

As is clear from the result, the image forming apparatuses of Examples are also good in fixing properties.

The image forming apparatus of Reference Example is an example using toner which contains an amorphous polyester resin in which an alkylene oxide adduct of bisphenol A is used. In the image forming apparatus of Reference Example, hot offset is less likely to occur in a high-temperature and high-humidity environment although the two-roller fixing device is used.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging device that charges a surface of the image holding member;

an electrostatic charge image forming device that forms an electrostatic charge image on the charged surface of the image holding member;

a developing device that includes an electrostatic charge image developer containing an electrostatic charge image developing toner and develops the electrostatic charge image to form a toner image on the surface of the image holding member;

a transfer device that transfers the toner image onto a recording medium; and a fixing device that fixes the toner image on the recording medium, wherein the fixing device includes a fixing belt that comes into contact with the toner image transferred to the surface of the recording medium, a rotational member that contacts with the outer surface of the fixing belt such that a contact area is formed between the rotational member and the fixing belt and that rotates together with the fixing belt to transport the recording medium, and a heater that is disposed so as to face the inner surface of the fixing belt to heat the contact area formed between the rotational member and the fixing belt;

the toner contains a binder resin that includes:

(i) a crystalline resin, and (ii) an amorphous polyester resin, in which an amount of an alkylene oxide adduct of bisphenol A, if present, is not more than 5 mol %, relative to a total amount of polyhydric alcohols;

a tetrahydrofuran-soluble component of toner particles has a weight average molecular weight Mw and a number average molecular weight Mn, the weight average molecular weight Mw is in the range of 25000 to 60000, and Mw/Mn is in the range of 5 to 10; and the toner has infrared absorption spectrum characteristics including: (i) a ratio of an absorbance at a wavelength of 1500 $cm^{-1}$ to an absorbance at a wavelength of 720 $cm^{-1}$ that is 0.6 or less, and (ii) a ratio of an absorbance at a wavelength of 820 $cm^{-1}$ to an absorbance at a wavelength of 720 $cm^{-1}$ that is 0.4 or less.

2. The image forming apparatus according to claim 1, wherein the ratio of the absorbance at the wavelength of 1500 $cm^{-1}$ to the absorbance at the wavelength of 720 $cm^{-1}$ that is 0.5 or less, and the ratio of the absorbance at the wavelength of 820 $cm^{-1}$ to the absorbance at the wavelength of 720 $cm^{-1}$ that is 0.3 or less.

3. The image forming apparatus according to claim 1, wherein the ratio of the absorbance at the wavelength of 1500 $cm^{-1}$ to the absorbance at the wavelength of 720 $cm^{-1}$ that is 0.2 or more, and the ratio of the absorbance at the wavelength of 820 $cm^{-1}$ to the absorbance at the wavelength of 720 $cm^{-1}$ that is 0.05 or more.

4. The image forming apparatus according to claim 1, wherein the infrared absorption spectrum characteristics further include a ratio of the absorbance at the wavelength of 820 $cm^{-1}$ to the absorbance at the wavelength of 1500 $cm^{-1}$ that is 0.5 or less.

5. The image forming apparatus according to claim 1, wherein the infrared absorption spectrum characteristics further include a ratio of the absorbance at the wavelength of 820 $cm^{-1}$ to the absorbance at the wavelength of 1500 $cm^{-1}$ that is 0.4 or less.

6. The image forming apparatus according to claim 1, wherein the tetrahydrofuran-soluble component of the toner particles has a peak molecular weight by gel permeation chromatography that is in the range of 7000 to 11000.

7. The image forming apparatus according to claim 1, wherein the tetrahydrofuran-soluble component of the toner particles has a peak molecular weight by gel permeation chromatography that is in the range of 8000 to 11000.

8. The image forming apparatus according to claim 1, wherein the amount of a toluene-insoluble component contained in the toner is from 28 mass % to 38 mass %.

9. The image forming apparatus according to claim 8, wherein the amount of the toluene-insoluble component contained in the toner is from 30 mass % to 35 mass %.

10. The image forming apparatus according to claim 1, wherein the amount of the crystalline resin is in the range of 3 mass % to 20 mass % relative to the amount of the whole toner.

11. The image forming apparatus according to claim 1, wherein the amount of the crystalline resin is in the range of 5 mass % to 15 mass % relative to the amount of the whole toner.

12. The image forming apparatus according to claim 1, wherein the fixing device further includes a pressure member that is disposed so as to face the inner surface of the fixing belt and that applies pressures to the fixing belt in the contact area in cooperation with the rotational member, and the heater heats the contact area with the pressure member interposed between the heater and the contact area.

13. The image forming apparatus according to claim 1, wherein the heater is a halogen lamp.

14. The image forming apparatus according to claim 13, wherein the fixing device further includes a reflection member that reflects radiant heat emitted from the halogen lamp toward the contact area.

15. The image forming apparatus according to claim 1, wherein the heater is a linear heating unit.

16. The image forming apparatus according to claim 15, wherein the fixing device further includes an energizing part that serves to pulse-energize the linear heating unit.

17. The image forming apparatus according to claim 1, wherein the image forming apparatus further includes a cooling part that serves to cool a fixed image after the fixing of the toner image transferred to the surface of the recording medium.

18. The image forming apparatus according to claim 1, wherein the fixing belt has a thickness ranging from 110 μm to 450 μm.

19. The image forming apparatus according to claim 1, wherein the fixing belt has a thickness ranging from 110 μm to 430 μm.

* * * * *